US008508324B2

(12) United States Patent
Moiseev

(10) Patent No.: US 8,508,324 B2
(45) Date of Patent: Aug. 13, 2013

(54) RADIATING STRUCTURE OF INDUCTION DEVICE

(75) Inventor: Sergey Moiseev, Kariya (JP)

(73) Assignee: Kabushiki Kaisha Toyota Jidoshokki (JP)

( * ) Notice: Subject to any disclaimer, the term of this patent is extended or adjusted under 35 U.S.C. 154(b) by 0 days.

(21) Appl. No.: 13/224,694

(22) Filed: Sep. 2, 2011

(65) Prior Publication Data

US 2012/0062350 A1 Mar. 15, 2012

(30) Foreign Application Priority Data

Sep. 9, 2010 (JP) ..... P2010-202059

(51) Int. Cl.
*H01F 27/04* (2006.01)
*H01F 17/04* (2006.01)

(52) U.S. Cl.
USPC ..... 336/212; 336/216; 336/221

(58) Field of Classification Search
USPC ..... 336/212, 216, 221, 222, 232
See application file for complete search history.

(56) References Cited

U.S. PATENT DOCUMENTS

| | | | | |
|---|---|---|---|---|
| 3,668,589 | A * | 6/1972 | Wilkinson | 336/212 |
| 4,013,911 | A * | 3/1977 | Fujiwara et al. | 340/870.35 |
| 4,308,495 | A * | 12/1981 | Yasumura | 323/250 |
| 4,498,067 | A * | 2/1985 | Kumokawa et al. | 336/65 |
| 5,062,197 | A * | 11/1991 | Ngo et al. | 29/606 |
| 5,479,146 | A * | 12/1995 | Herbert | 336/61 |
| 5,635,890 | A * | 6/1997 | Yamaguchi et al. | 336/83 |
| 6,195,232 | B1 * | 2/2001 | Cohen | 360/123.38 |
| 6,583,697 | B2 * | 6/2003 | Koyama et al. | 336/83 |
| 6,720,855 | B2 * | 4/2004 | Vicci | 336/178 |
| 7,057,486 | B2 * | 6/2006 | Kiko | 336/178 |
| 7,199,695 | B1 * | 4/2007 | Zhou et al. | 336/212 |
| 7,449,984 | B2 * | 11/2008 | Kawarai | 336/83 |
| 8,098,123 | B2 * | 1/2012 | Sutardja | 335/296 |
| 2007/0120758 | A1 * | 5/2007 | Takahashi | 343/788 |
| 2007/0296533 | A1 * | 12/2007 | Springett | 336/200 |

FOREIGN PATENT DOCUMENTS

JP 2002-057039 2/2002

* cited by examiner

*Primary Examiner* — Mohamad Musleh
*Assistant Examiner* — Joselito Baisa
(74) *Attorney, Agent, or Firm* — Woodcock Washburn LLP

(57) ABSTRACT

A magnetic core includes a first core and a second core made of a material whose magnetic permeability is smaller than that of the first core and having an end. The end of the second core is in contact with the first core so that the first core and the second core cooperate to form a closed magnetic circuit. The area of contact between the end of the second core and the first core is larger than the area of the cross-section of the end as taken perpendicularly to the extending direction of the end of the second core.

9 Claims, 14 Drawing Sheets plan view side view front view plan view

B–B cross section

A–A cross section plan view side view front view plan view side view

A–A cross section plan view side view

A-A cross section plan view side view

A-A cross section

RADIATING STRUCTURE OF INDUCTION DEVICE

CROSS REFERENCE TO RELATED APPLICATIONS

This application claims priority to Japanese Patent Application No. 2010-202059 filed Sep. 9, 2010.

BACKGROUND OF THE INVENTION

The present invention relates to a magnetic core and an induction device.

A ferrite material whose magnetic permeability is high and a dust material whose magnetic permeability is low are used as materials for a core of an induction device. In using a core made of a ferrite material, when a gap is provided for the core so as to optimize the magnetic resistance required for assuring the DC superposition characteristic, the loss is increased by magnetic flux due to the gap. On the other hand, when a core made of a dust material is used and the number of winding turns of a coil around the core is increased, the conduction loss is increased due to the large number of winding turns of the coil.

Japanese Unexamined Patent Application Publication 2002-57039 discloses a magnetic core that is made of a plurality of different materials, i.e., ferrite and dust, dispenses with the gap for the core and decreases the number of winding turns of the coil around the core.

When a core is made of a plurality of different materials, i.e., ferrite and dust, the DC superposition characteristic is determined by the saturation magnetic flux densities of the ferrite core and the dust core. Since the saturation magnetic flux density of the ferrite core is smaller than that of the dust core, the area of the cross-section of the ferrite core needs to be increased. The upper drawing of FIG. 14 shows a magnetic core composed of a dust core 200 and a ferrite core 201 having substantially the same cross sectional areas t10 and t11, respectively. In such magnetic core, increasing the cross sectional areas t10, t11 of the respective cores 200, 201 will increase the size of the magnetic core as a matter of course. For reducing the size of the magnetic core, the dust core 200 may be made with a decreased cross sectional area relative to the ferrite core 201, as shown by the dust core 202 and the ferrite core 203 in the lower drawing of FIG. 14. In such magnetic core, however, the area of contact between the ferrite core 203 and the dust core 202 is decreased due to the decreased cross sectional area of the dust core 202, with the result that the DC superposition of the coil cannot be optimized.

The present invention is directed to providing a magnetic core and an induction device which can be made small while maintaining the desired DC superposition characteristic.

SUMMARY OF THE INVENTION

A magnetic core includes a first core and a second core made of a material whose magnetic permeability is smaller than that of the first core and having an end. The end of the second core is in contact with the first core so that the first core and the second core cooperate to form a closed magnetic circuit. The area of contact between the end of the second core and the first core is larger than the area of the cross-section of the end as taken perpendicularly to the extending direction of the end of the second core.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1A:
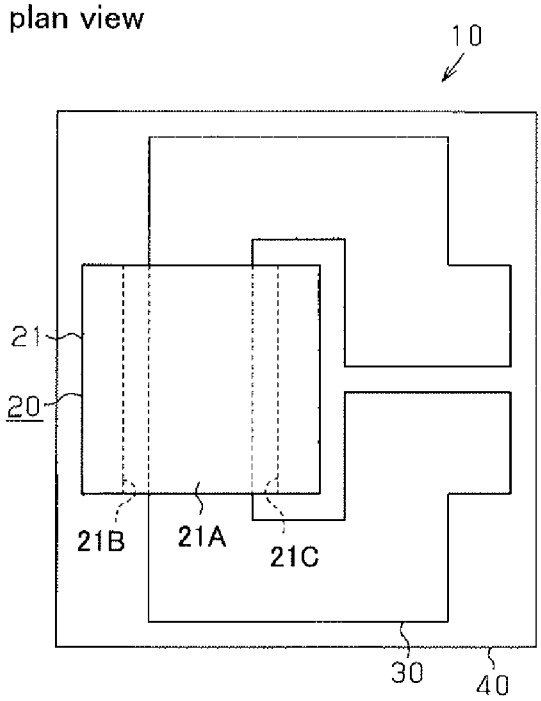
FIG. 1A is a plan view of an induction device according to a first embodiment of the present invention.
Figure 1C:
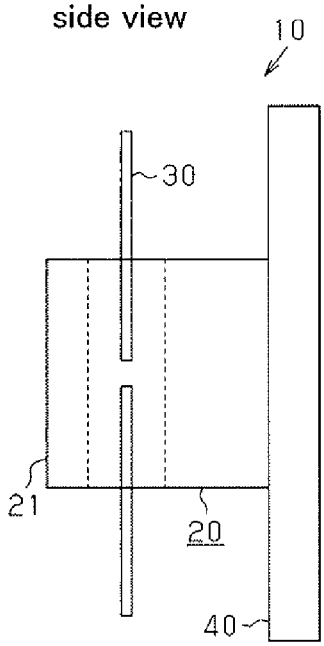
FIG. 1C is a side view of the induction device of FIG. 1A.
Figure 1B:
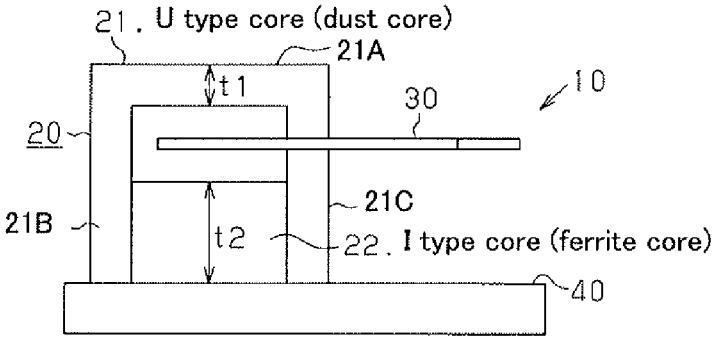
FIG. 1B is a front view of the induction device of FIG. 1A.
Figure 2:
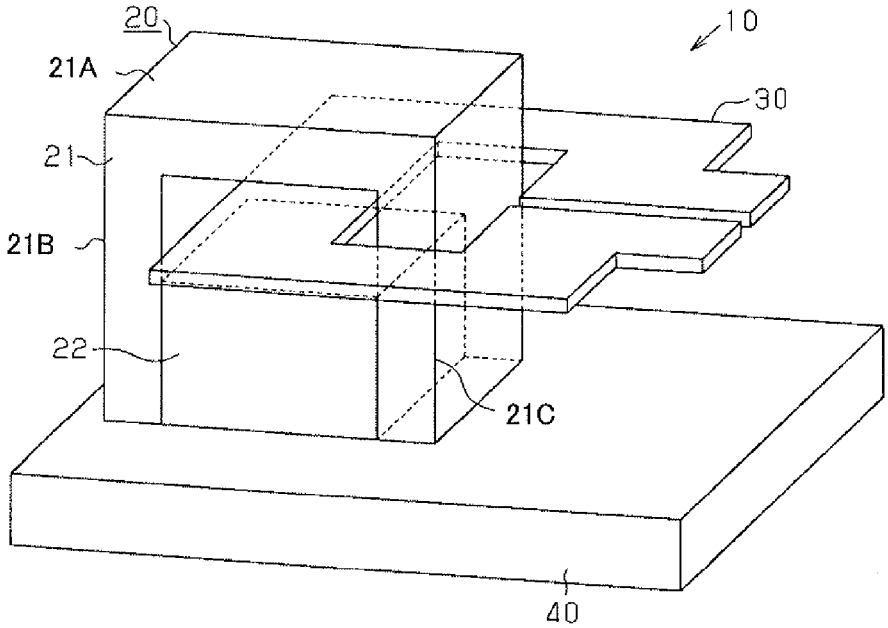
FIG. 2 is a perspective view of the induction device of FIG. 1A.
Figure 3:
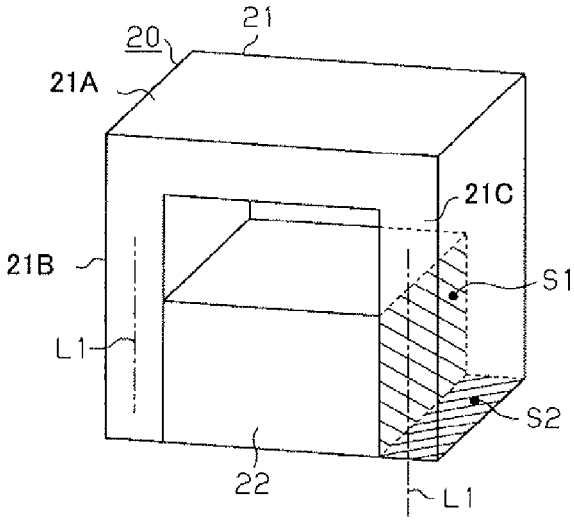
FIG. 3 is a perspective view of a core of the induction device of FIG. 1A.

The following will describe the magnetic core, which will be referred to merely as "core" hereinafter and the induction device according to the first embodiment of the present invention with reference to the accompanying drawings. The induction device according to the first embodiment is shown in FIG. 1 and designated generally by 10. FIGS. 1A, 1B, 1C shows the induction device 10 in plan view, front view and side view, respectively. FIG. 2 is a perspective view of the induction device 10 and FIG. 3 is a perspective view of a core designated generally by 20 and used for the induction device 10.

Referring to FIG. 1, the induction device 10 serving as a reactor includes the core 20, a coil 30 and a radiator plate 40 made of aluminum. The core 20 employs a U-I type core composed of a U type core 21 and an I type core 22.

The U type core 21 includes a plate portion 21A and leg portions 21B, 21C. The plate portion 21A is shaped in the form of a rectangular parallelepiped. The leg portions 21B, 21C extend parallel to each other downward from the opposite ends of the plate portion 21A. The leg portions 21B, 21C are also shaped in the form of a rectangular parallelepiped and face each other. The U type core 21 has a thickness t1.

The I type core 22 is shaped in the form of a rectangular parallelepiped and has a thickness t2. The I type core 22 is disposed between the ends of the leg portions 21B, 21C of the U type core 21. One end surface of the I type core 22 and the inner surface at the end of the leg portion 21B of the U type core 21 are set in contact with each other and the other surface of the I type core 22 that is opposite from the leg portion 21B and the inner surface at the end of the leg portion 21C of the U type core are set in contact with each other.

Thus, the I type core 22 is disposed in contact with the U type core 21 at the ends of the leg portions 21B, 21C thereof so that the U type core 21 and the I type core 22 cooperate to form a closed magnetic circuit. Referring to FIGS. 1, 2, numeral 30 designates a coil that is made of a copper band plate formed in an annular rectangular shape. Specifically, the coil 30 is made of a thick copper plate. The coil 30 is wound around the leg portion 21C of the U type core 21 horizontally.

The U type core 21 is of a dust core made of a dust material. Specifically, Fe—Al—Si material may be used for the U type dust core 21. The I type core 22 is of a ferrite core made of a ferrite material. Specifically, MnZn material or NiMn material may be used for the I type ferrite core 22.

Thus, the U type core 21 is made of a material whose magnetic permeability is smaller than that of the I type core 22. Since the saturation magnetic flux density of the ferrite core is smaller than that of the dust core, the I type core 22 is made with the large thickness t2 thereby to increase the cross sectional area of the I type ferrite core 22. On the other hand, the U type core 21 is made with the thickness t1 that is smaller than the thickness t2 of the I type core 22 so as to downsize the core. Accordingly, the cross sectional area of the U type core 21 is made smaller than that of the I type core 22.

As shown in FIG. 3, the cross sectional area of the respective leg portions 21B, 21C, i.e., the area of the cross-section of the respective ends of the U type core 21 as taken perpendicularly to the extending direction L1 of the leg portions 21B, 21C is indicated by S2. The area where the I type core 22 and the U type core 21 face in contact with each other, i.e., the area of contact between the end of the U type core 21 and the I type core 22, is indicated by S1.

Figure 14:
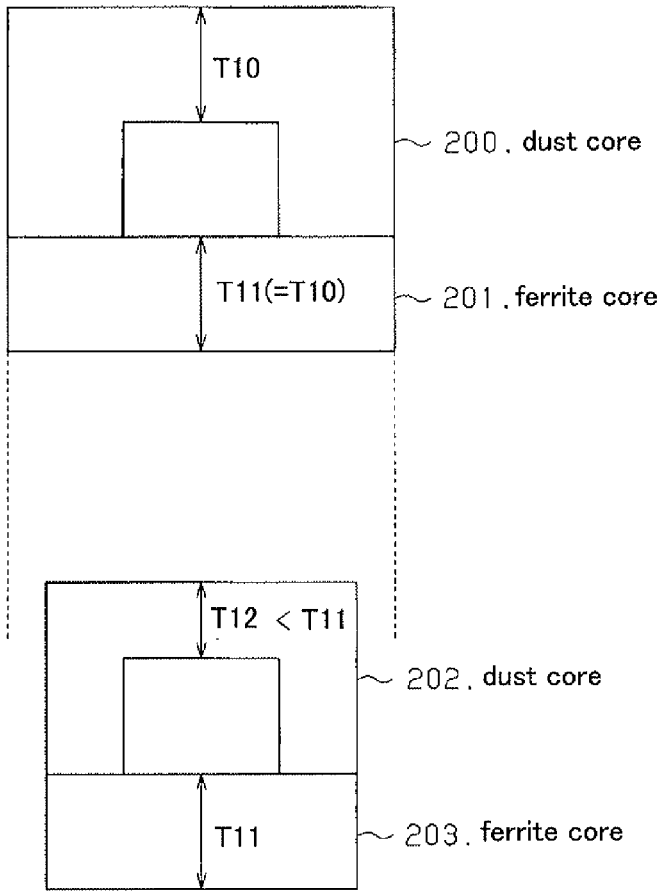
FIG. 14 is a front view of a core of an induction device according to a prior art.

The area S1 where the I type core 22 and the U type 21 are in contact with each other is larger than the cross sectional area S2 of each leg portion 21B, 21C as taken perpendicularly to the extending direction L1 of the leg portions 21B, 21C. As compared with the case shown in the upper drawing of FIG. 14 where both of the cross sectional areas of the I type core 22 and the U type core 21 are large, the core 20 can be downsized by making the cross sectional area S2 of the U type core 21 small. In other words, when the I type core 22 and the U type core 21 are set in contact with each other, the contact area S1 of the I type core 22 can be made larger than the cross sectional area S2 of the U type core 21 whose size is small. As a result, the DC superposition characteristic of the coil can be optimized.

As shown in FIGS. 1 and 2, the radiator plate 40 is made of a rectangular parallelepiped and disposed horizontally. The I type core 22 is mounted on the radiator plate 40 with the lower surface thereof set in contact with the upper surface of the radiator plate 40.

The U type core 21 is mounted on the radiator plate 40 and disposed with the leg portions 21B, 21C thereof extending parallel to each other downward from the opposite ends of the plate portion 21A. The I type core 22 is disposed between and in contact with the leg portions 21B, 21C of the U type core 21. The U type core 21 is disposed with the end surfaces of the leg portions 21B, 21C thereof set in contact with the upper surface of the radiator plate 40.

The core 20 (or combination of the U type core 21 and the I type core 22) generates heat when the coil 30 is energized. Since the lower end surfaces of the leg portions 21B, 21C are in contact with the upper surface of the radiator plate 40, the heat generated by the U type core 21 can be transferred to the radiator plate 40 easily. Heat resistance can be reduced by increasing the area 51 where the U type core 21 and the I type core 22 are in contact with each other.

The first embodiment of the present invention offers the following advantageous effects.

(1) The magnetic core 20 includes the I type core 22 as the first core of the present invention and the U type core 21 as the second core of the present invention, which cooperate to form a closed magnetic circuit in a manner that the respective ends of the U type core 21 are in contact with the I type core 22. The induction device 10 includes the core 20 and the coil 30 wound around the U type core 21 (or the coil 30 may be wound around the I type core 22). The U type core 21 and the I type core 22 are of a dust core and a ferrite core, respectively and the U type core 21 is made of a material whose magnetic permeability is smaller than that of the I type core 22. The area S1 where the end of the U type core 21 and the I type core 22 are in contact with each other is larger than the area of the cross-section S2 of the end of the U type core 21 as taken perpendicularly to the extending direction L1 of the end of the U type core 21. Thus, the core 20 can be downsized while maintaining the DC superposition characteristic of the coil by increasing the area S1.

Figure 4:
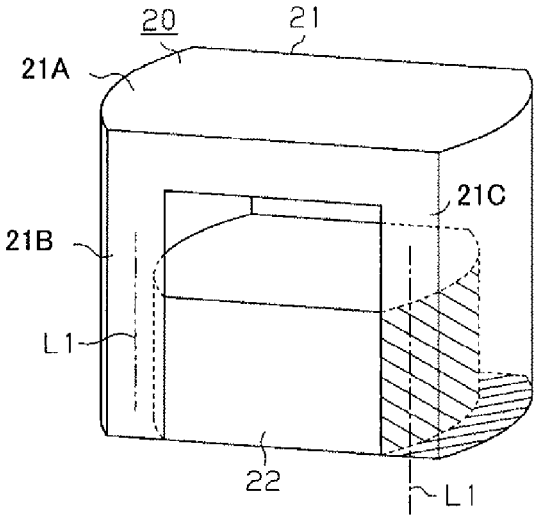
FIG. 4 is a perspective view of an alternative core according to the first embodiment.

(2) The U type core 21 as the second core set in contact with the radiator plate 40 as the radiator improves its radiating efficiency. As shown in FIG. 3, the area Si where the leg portions 21B, 21C and their corresponding side surfaces of the I type core 22 are in contact with each other extends linearly in the depth direction as seen in the perspective view of FIG. 3. As shown in FIG. 4, however, the areas where the leg portions 21B, 21C of the U type core 21 and their corresponding side surfaces of the I type core 22 are in contact with each other may extend forming an arcuate-shape in the depth direction in the perspective view of FIG. 4.

The following will describe the second embodiment focusing on the difference between the first and the second embodiments.

Figure 5:
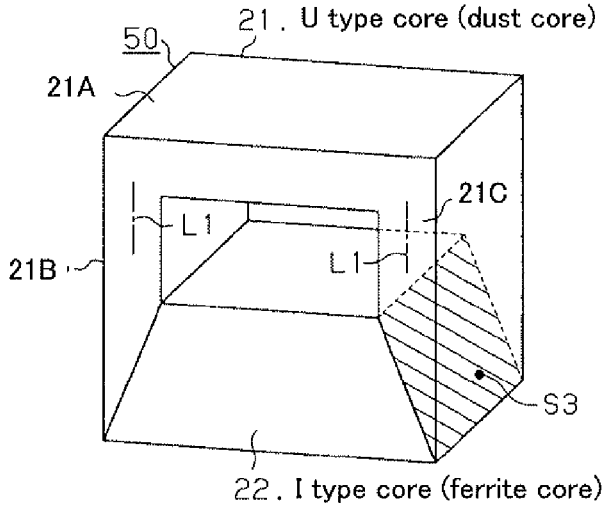
FIG. 5 is a perspective view of a core according to a second embodiment.

FIG. 5 shows a U-I core 50 according to the second embodiment that is different from the core 20 according to the first embodiment shown in FIG. 3 in that the areas where the leg portions 21B, 21C and their corresponding side surfaces of the I type core 22 of the U-I core 50 are in contact with each other are inclined.

Referring to FIG. 5, the cross sectional areas of the respective leg portions 21B, 21C or the areas of the cross-sections of the ends of the U type core 21 as taken perpendicularly to the extending direction L1 of the leg portions 21B, 21C are the same as S2 that is indicated in FIG. 3. In the second embodiment shown in FIG. 5, the area where the end of the U type core 21 and the I type core 22 are in contact with each other is indicated by S3. The area S3 is larger than the area S2.

Figure 6:
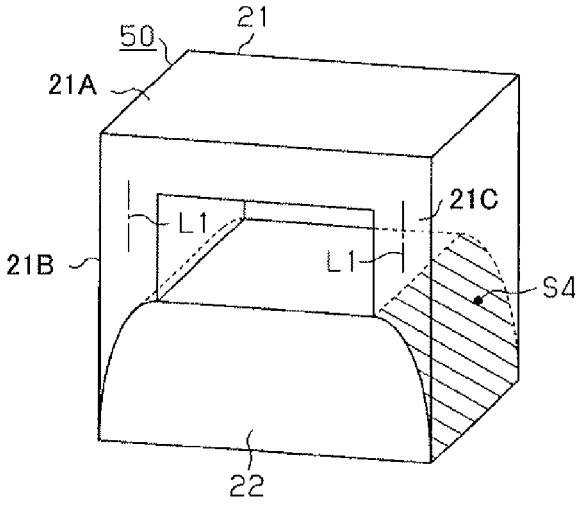
FIG. 6 is a perspective view of an alternative core according to the second embodiment.

In the U-I core 50 shown in FIG. 5, the area S3 where the I type core 22 and the U type core 21 are in contact with each other is made larger than the area S1 shown in FIG. 3 because the area S3 of FIG. 5 is inclined. The areas S3 where the leg portions 21B, 21C of the U type core 21 and their corresponding side surfaces of the I type core 22 are in contact with each other are formed linearly as shown in FIG. 5. However, the area may be formed not linearly but arcuate-shaped. As shown in FIG. 6, the area that is designated by S4 is formed arcuate-shaped. In this case, the areas S4 is made larger than the areas S3 shown in FIG. 5.

The following will describe the third embodiment focusing on the difference between the first and the third embodiments.

Figure 7A:
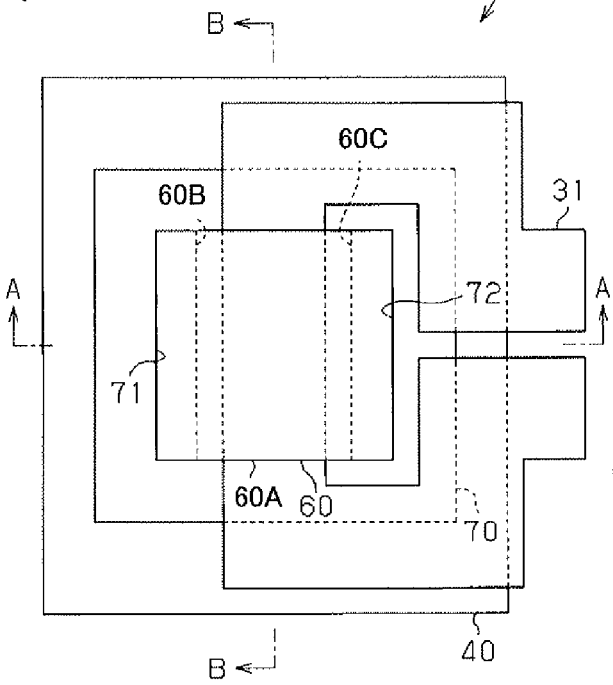
FIG. 7A is a plan view of an induction device according to a third embodiment.
Figure 7C:
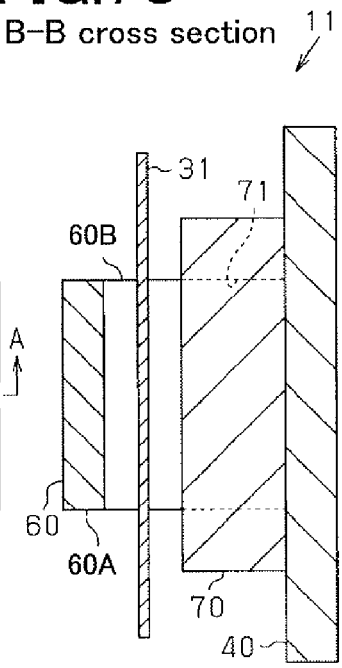
FIG. 7C is a traverse sectional view taken along the line B-B in FIG. 7A.
Figure 7B:
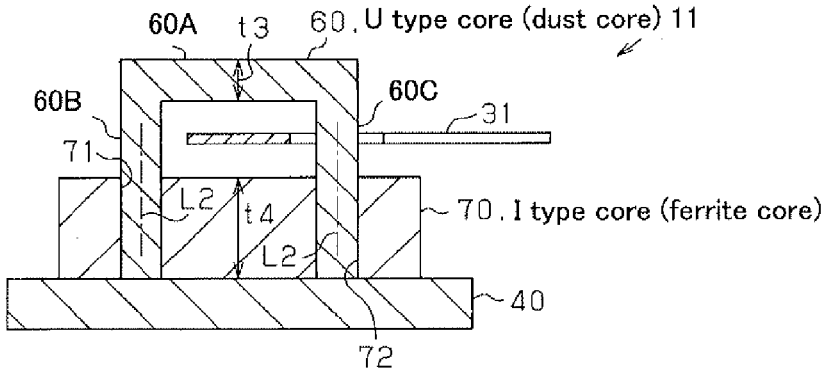
FIG. 7B is a longitudinal sectional view taken along the line A-A in FIG. 7A.

FIG. 7 shows an induction device 11 according to the third embodiment. FIG. 7A is a plan view of the induction device 11, FIG. 7B is a longitudinal sectional view taken along the line A-A in FIG. 7A and FIG. 7C is a traverse sectional view taken along the line B-B in FIG. 7A.

The induction device 11 according to the third embodiment employs a U-I type core that is composed of a U type dust core 60 as the second core and an I type ferrite core 70 as the first core. The I type core 70 is disposed horizontally on the upper surface of the radiator plate 40. The I type core 70 has formed vertically therethrough two holes 71, 72. The cross-section of the holes 71, 72 is rectangular-shaped.

The U type core 60 includes a horizontal plate portion 60A and vertical leg portions 60B, 60C. The plate portion 60A is shaped in the form of a rectangular parallelepiped. The leg portions 60B, 60C extend parallel to each other downward from the opposite ends of the plate portion 60A. The leg portions 60B, 60C are shaped in the form of a rectangular parallelepiped and face each other.

The leg portions 60B, 60C of the U type core 60 are fitted in the holes 71, 72 of the I type core 70, respectively, so that U type core 60 and the I type core 70 are in contact with each other at the inner surfaces of the holes 71, 72 of the I type core 70.

The lower end surfaces of the leg portions 60B, 60C of the U type core 60 are in contact with the upper surface of the radiator plate 40, so that the heat generated by the core can be radiated efficiently. A coil 31 that is made of a copper band plate is bound around the leg portion 60C of the U type core 60 horizontally.

In the third embodiment, the leg portions 60B, 60C of the U type core 60 are fitted in the holes 71, 72 and in contact with the inner surfaces of the holes 71, 72, respectively. The lower end surfaces of the leg portions 60B, 60C of the U type core 60 are in contact with the upper surface of the radiator plate 40. The I type ferrite core 70 has formed therethrough the holes 71, 72 in which part of the U type core 60 is fitted and the lower ends of the U type core 60 are flush with the lower end surface of the I type core 70.

The U type core 60 is made with the thickness t3 at the plate portion 60A that is smaller than the thickness t4 of the I type core 70. Accordingly, the cross sectional area of the U type core 60 is smaller than that of the I type core 70.

The area where the leg portions 60B, 60C that are the ends of the U type core 60 as the second core and the I type core 70 as the first core are in contact with each other is larger than the area of the cross section of the end of the U type core 60 as taken perpendicularly to the extending direction L2 of the leg portions 60B, 60C of the U type core 60. Therefore, the area of contact between the U type core 60 and the I type core 70 is large enough to maintain the DC superposition characteristic of the coil and to make the induction device 11 small.

The I type core 70 has formed therethrough the holes 71, 72 in which the leg portions 60B, 60C of the U type core 60 are fitted and, therefore, the area of contact between the I type core 70 and the U type core 60 can be increased suitably.

In the third embodiment of FIG. 7, the cross-sections of the holes 71, 72 and the leg portions 60B, 60C of the U type core 60 are rectangular-shaped. The shape of these cross-sections is not limited to be rectangular-shaped but may be square-shaped or circular-shaped.

The following will describe the fourth embodiment focusing on the difference between the first and the fourth embodiments.

Figure 8A:
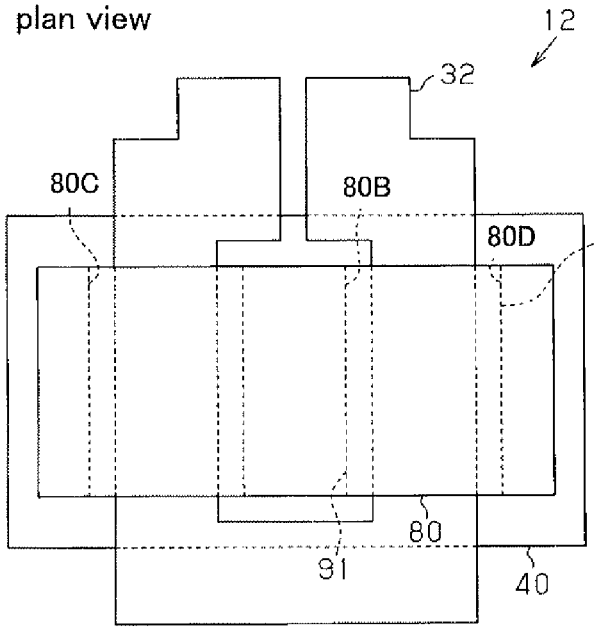
FIG. 8A is a plan view of an induction device according to a fourth embodiment of the present invention.
Figure 8C:
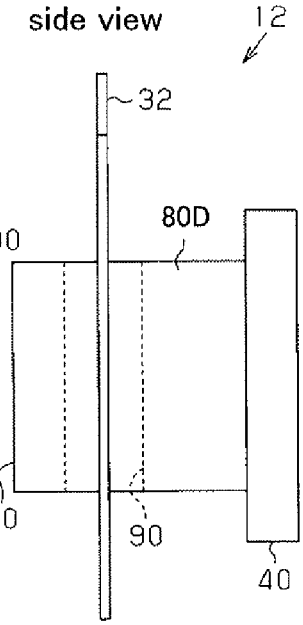
FIG. 8C is a side view of the induction device of FIG. 8A.
Figure 8B:
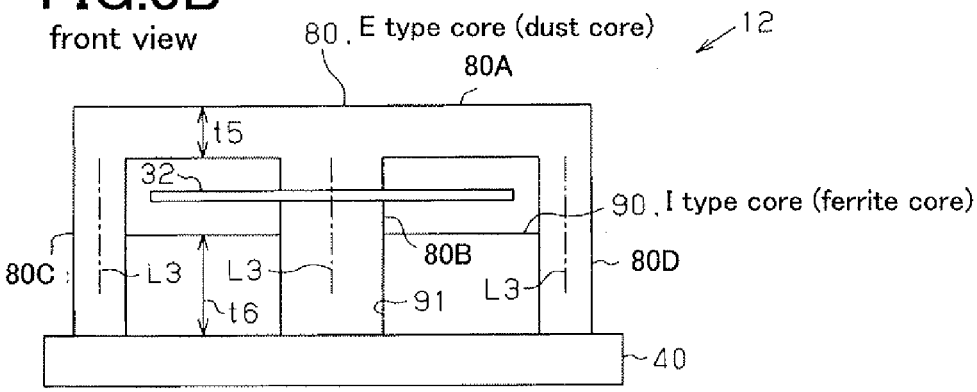
FIG. 8B is a front view of the induction device of FIG. 8A.

FIG. 8 shows an induction device 12 according to the fourth embodiment. FIG. 8A is a plan view, FIG. 8B is a front view and FIG. 8C is a side view of the induction device 12. The induction device 12 employs an E-I type core composed of an E type dust core 80 as the second core and an I type ferrite core 90 as the first core.

The E type core 80 includes a horizontal main portion 80A, a center leg portion 80B and side leg portions 80C, 80D. The main portion 80A is shaped in the form of a rectangular parallelepiped. The center and the side leg portions 80B, 80C, 80D extend parallel to each other downward from the center and the opposite ends of the main portion 80A, respectively. The center and the side leg portions 80B, 80C, 80D are shaped in the form of a rectangular parallelepiped and the center leg portion 80B faces the respective side leg portions 80C, 80D.

The I type core 90 is in contact with the upper surface of the radiator plate 40. The I type core 90 has formed vertically therethrough a hole 91 whose cross-section is rectangular-shaped.

The center leg portion 80B of the E type core 80 is fitted in the hole 91 of the I type core 90 and the lower end surface of the center leg portion 80B of the E type core 80 is in contact with the radiator plate 40. The side surfaces of the side leg portions 80C, 80D of the E type core 80 are in contact with their adjacent side surfaces of the I type core 90 and the lower end surfaces of the side leg portions 80C, 80D are in contact with the upper surface of the radiator plate 40.

The center leg portion 80B of the E type core 80 are in contact with the I type core 90 at the inner surface of the hole 91 of the I type core 90. A coil 32 that is made of a copper band plate is bound around the center leg portion 80B of the E type core 80 horizontally.

The thickness t5 of the E type core 80 at the main portion 80A is smaller than the thickness t6 of the I type core 90 for downsizing the core. Accordingly, the cross sectional area of the E type core 80 is smaller than that of the I type core 90.

The area where the center and the side leg portions 80B, 80C, 80D, that are the ends of the E type core 80 as the second core, and the I type core 90 as the first core are in contact with each other is larger than the area of the cross-section of the E type core 80 as taken perpendicularly to the extending direction L3 of the center and the side leg portions 80B, 80C, 80D of the E type core 80. Therefore, the area of contact between the E type core 80 and the I type core 90 is large enough to maintain the DC superposition characteristic of the coil and to make the induction device 12 small.

The following will describe the fifth embodiment focusing on the difference between the first and the fifth embodiments.

Figure 9:
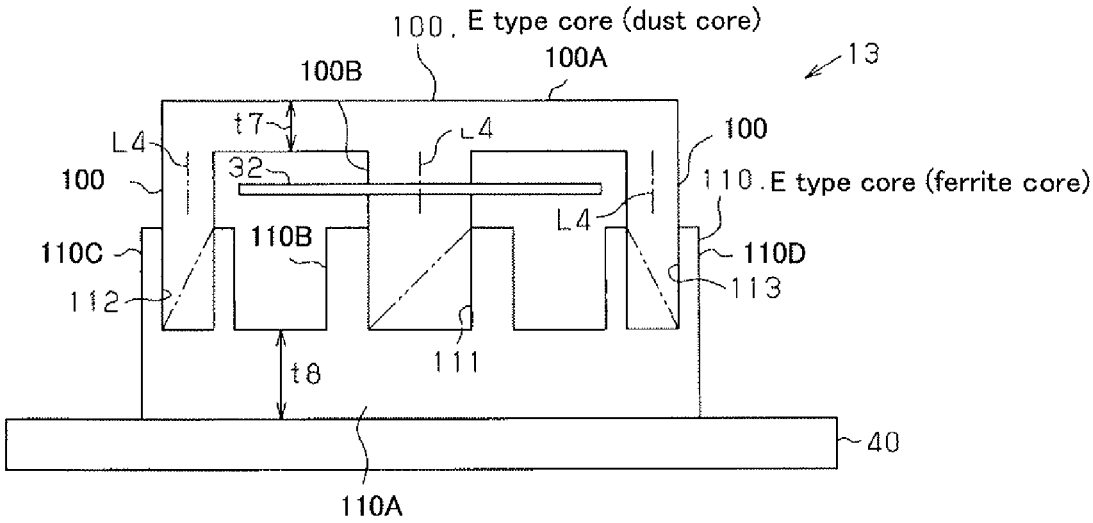
FIG. 9 is a front view of an induction device according to a fifth embodiment of the present invention.

FIG. 9 is a front view of the induction device 13 according to the fifth embodiment. The induction device 12 employs an E-E type core composed of an upper E type dust core 100 as the second core and a lower E type ferrite core 110 as the first core. The upper E type core 100 includes a horizontal main portion 100A, a center leg portion 100B and side leg portions 100C, 100D. The main portion 100A is shaped in the form of a rectangular parallelepiped. The center and the side leg portions 100B, 100C, 100D extend parallel to each other downward from the center and the opposite ends of the main portion 100A, respectively. The center and the side leg portions 100B, 100C, 100D are shaped in the form of a rectangular parallelepiped and the center leg portion 100B faces the respective side leg portions 100C, 100D.

The lower E type core 110 includes a horizontal main portion 110A, a center leg portion 110B and side leg portions 110C, 110D. The main portion 110A is shaped in the form of a rectangular parallelepiped and disposed on the upper surface of the radiator plate 40. The center and the side leg portions 110B, 110C, 110D extend parallel to each other upward from the center and the opposite ends of the main portion 110A, respectively. The center and the side leg portions 110B, 110C, 110D are shaped in the form of a rectangular parallelepiped and the center leg portion 110B faces the respective side leg portions 110C, 110D.

A recess 111 is formed in the end (or the upper surface) of the center leg portion 110B of the lower E type core 110. Similarly, recesses 112, 113 are formed in the ends (or the upper surfaces) of the side leg portions 110C, 110D of the lower E type core 110, respectively.

The center leg portion 100B of the upper E type core 100 is fitted in the recess 111 of the lower E type core 110. Similarly, the side leg portions 100C, 100D of the upper E type core 100 are fitted in the recesses 112, 113 of the lower E type core 110, respectively. The center and the side leg portions 100B, 100C, 100D of the upper E type core 100 are in contact with the lower E type core 110 at the inner surfaces of the recesses 111, 112, 113 of the lower E type core 110, respectively.

A coil 32 that is made of a copper band plate is bound around the center leg portion 100B of the upper E type core 100 horizontally. The thickness t7 of the upper E type core 100 at the main portion 100A thereof is smaller than the thickness t8 of the lower E type core 110. Accordingly, the cross sectional area of the upper E type core 100 is smaller than that of the lower E type core 110.

The area of contact between the center and the side leg portions 100B, 100C, 100D that are the ends of the upper E type core 100 as the second core and the lower E type core 110 as the first core is larger than the area of the cross-section of the upper E type core 100 as taken perpendicularly to the extending direction L4 of the center and the side leg portions 100B, 100C, 100D of the upper E type core 100. Therefore, the area of contact between the upper E type core 100 and the lower E type core 110 can be made large enough to maintain the DC superposition characteristic of the coil and also to make the induction device 13 small.

Since the ends (or the center and the side leg portions 100B, 100C, 100D) of the upper E type core 100 are fitted in the recesses 111, 112, 113 that are formed in the lower E type core 110, the area of contact between the upper E type core 100 and the lower E type core 110 can be increased suitably.

Alternatively, the lower end surfaces of the center and the side leg portions 100B, 100C, 100D of the upper E type core 100 and the bottom surfaces of the recesses 111, 112, 113 indicated by chain double-dashed lines in FIG. 9 may be formed to be inclined.

The following will describe the sixth embodiment focusing on the difference between the first and the sixth embodiments.

Figure 10:
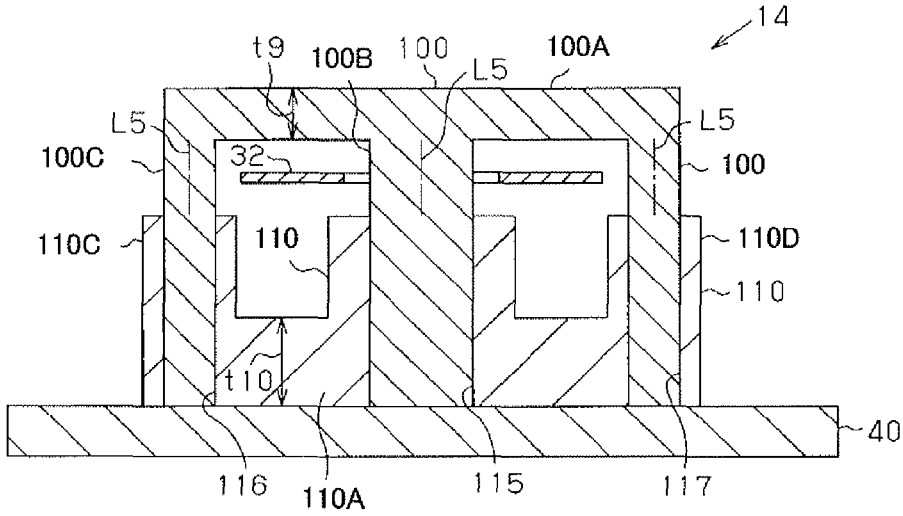
FIG. 10 is a longitudinal sectional view of an induction device according to a sixth embodiment of the present invention.

FIG. 10 shows a longitudinal sectional view of the induction device 14 according to the sixth embodiment. The induction device 14 employs an E-E type core composed of an upper E type dust core 100 as the second core and a lower E type ferrite core 110 as the first core. The lower E type core 110 includes a horizontal main portion 110A disposed on the upper surface of the radiator plate 40. The lower E type core 110 has formed vertically therethrough three holes 115, 116, 117.

The center leg portion 100B of the upper E type core 100 is fitted in the hole 115 of the lower E type core 110 in a manner that the lower surface of the center leg portion 100B of the upper E type core 100 contacts with the upper surface of the radiator plate 40. Similarly, the side leg portions 100C, 100D of the upper E type core 100 are fitted in the holes 116, 117 of the lower E type core 110 in a manner that the lower surfaces of the side leg portions 100C, 100D of the upper E type core 100 contact with the upper surface of the radiator plate 40.

The center and the side leg portions 100B, 100C, 100D of the upper E type core 100 contact with the lower E type core 110 at the inner surfaces of the holes 115, 116, 117 of the lower E type core 110, respectively.

The thickness t9 of the upper E type core 100 is smaller than the thickness t10 of the lower E type core 110. Accordingly, the cross sectional area of the upper E type core 100 is smaller than that of the lower E type core 110.

The area of contact between the center and the side leg portions 100B, 100C, 100D of the upper E type core 100 and the lower E type core 110 is larger than the area of the cross-section of the upper E type core 100 as taken perpendicularly to the extending direction L5 of the center and the side leg portions 100B, 100C, 100D of the upper E type core 100. Therefore, the area of contact between the upper E type core 100 and the lower E type core 110 can be made large enough to maintain the DC superposition characteristic of the coil and also to make the induction device 14 small. As compared with the induction device 13 shown in FIG. 9, the heat radiation in the induction device 14 of the sixth embodiment is accomplished more efficiently in that the lower end surfaces of the upper E type core 100 of the induction device 14 are in contact with the radiator plate 40.

The following will describe the seventh embodiment focusing on the difference between the first and the seventh embodiments.

Figure 11A:
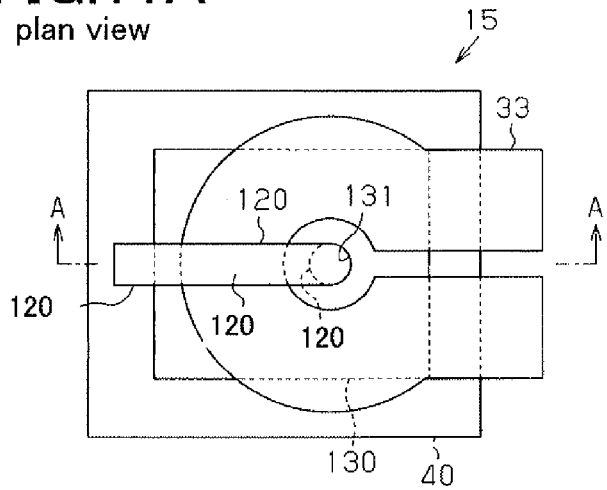
FIG. 11A is a plan view of an induction device according to a seventh embodiment of the present invention.
Figure 11C:
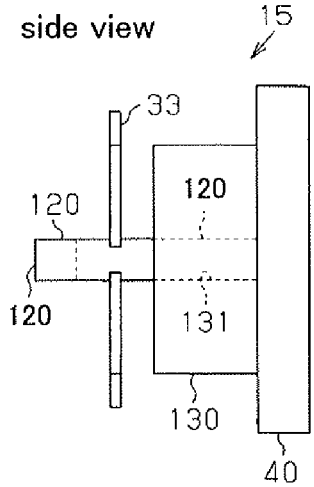
FIG. 11C is a side view of the induction device of FIG. 11A.
Figure 11B:
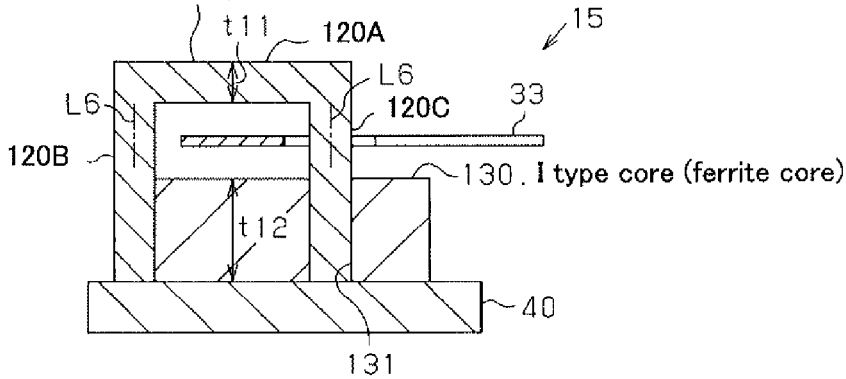
FIG. 11B is a longitudinal sectional view taken along the line A-A of FIG. 11A.

FIG. 11 shows an induction device 15 according to the seventh embodiment. FIG. 11A is a plan view of the induction device 15, FIG. 11B is a longitudinal sectional view taken along the line A-A in FIG. 11A and FIG. 11C is a side view of the induction device 15.

The induction device 15 employs a U-I type core composed of a U type dust core 120 as the second core and an I type ferrite core 130 as the first core. The I type core 130 is disposed on the upper surface of the radiator plate 40. The I type core has formed vertically therethrough a hole 131 whose cross-section is circular-shaped.

The U type core 120 includes a horizontal connection portion 120A and vertical leg portions 120B, 120C. The connection portion 120A is rectangular-shaped as viewed in the plan view of FIG. 11A and disposed horizontally. The leg portions 120B, 120C extend parallel to each other downward from opposite ends of the connection portion 120A. As shown in FIG. 11A, one leg portion 120C is circular and the other leg portion 120B is rectangular in cross-section.

The leg portion 120C of the U type core 120 is fitted in the hole 131 of the I type core 130 and the lower surface of the leg portion 120C contacts with the upper surface of the radiator plate 40. The leg portion 120C also contacts with the I type core 130 at the inner surface of the through-hole 131. The side surface of the leg portion 120B of the U type core 120 contacts with the side surface of the I type core 130 and the lower surface of the leg portion 120B contacts with the upper surface of the radiator plate 40.

A coil 33 that is made of a copper band plate is bound around the leg portion 120C of the U type core 120 horizontally. The thickness t11 of the U type core 120 is smaller than the thickness t12 of the I type core 130 for downsizing the core. Accordingly, the cross sectional area of the U type core 120 is smaller than that of the I type core 120.

The area of contact between the leg portions 120B, 120C that are the ends of the U type core 120 as the second core and the I type core 130 as the first core is larger than the area of the cross-section of the U type core 120 as taken perpendicularly to the extending direction L6 of the leg portions 120B, 120C of the U type core 120. Therefore, the area of contact between the U type core 120 and the I type core 130 can be made large enough to maintain the DC superposition characteristic of the coil and also to make the induction device 15 small in size.

Figure 12A:
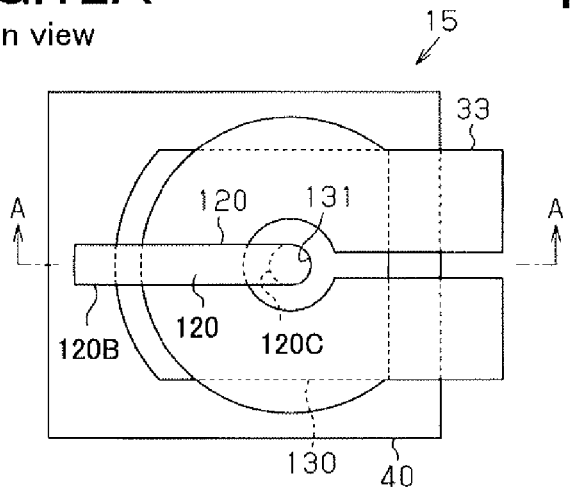
FIG. 12A is a plan view of an induction device according to an alternative embodiment of the present invention.
Figure 12C:
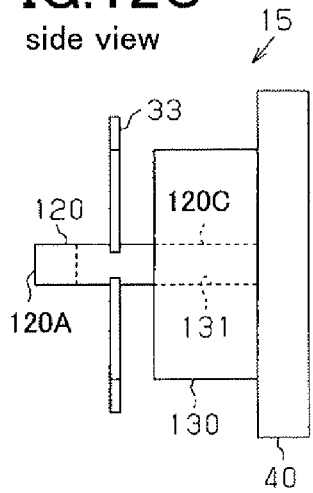
FIG. 12C is a side view of the induction device of FIG. 12A.
Figure 12B:
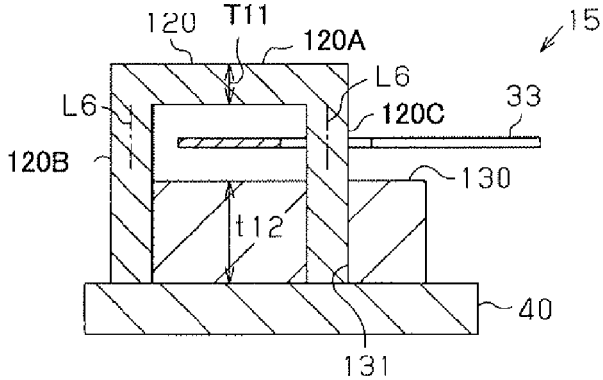
FIG. 12B is a longitudinal sectional view taken along the line A-A of FIG. 12A.

The surface of contact between the side surface of the leg portion 120B of the U type core 120 and the side surface of the I type core 130 extends linearly as seen in plan view of the induction device 15 in FIG. 11A. However, the induction device 15 may be modified in a manner that the surface of contact between the side surface of the leg portion 120B of the U type core 120 and the side surface of the I type core 130 extends in the shape of arc as shown in FIG. 12A as a plan view of the induction device 15. In this case, the area of contact between the leg portion 120B of the U type core 120 and the I type core 130 can be made larger as compared with the case shown in FIG. 11A.

Figure 13A:
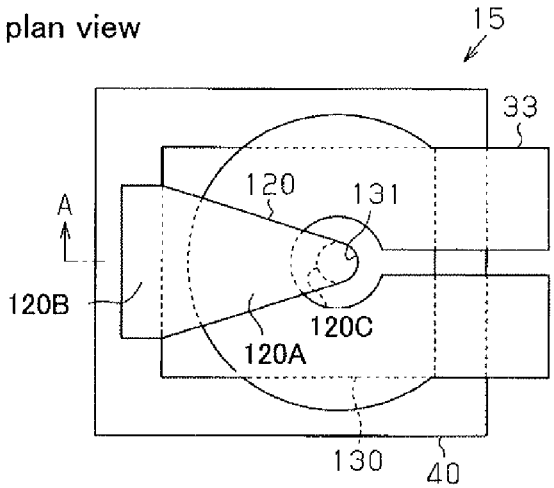
FIG. 13A is a plan view of an induction device according to another alternative embodiment of the present invention.
Figure 13C:
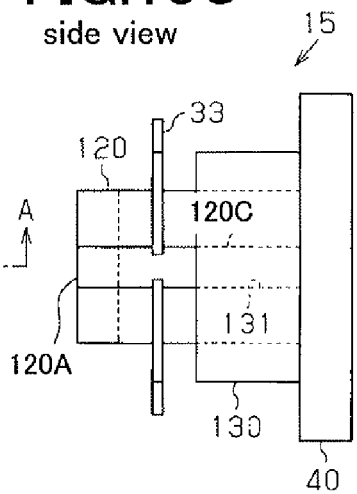
FIG. 13C is a side view of the induction device of FIG. 13A.
Figure 13B:
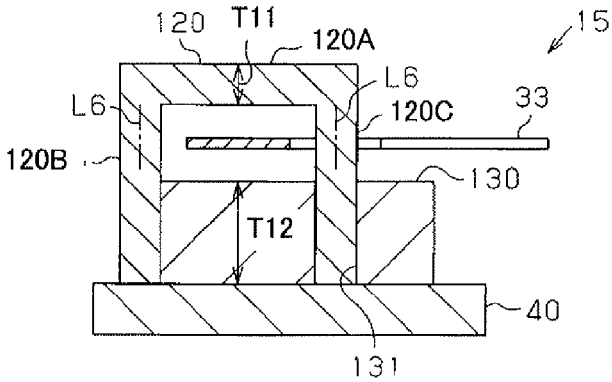
FIG. 13B is a longitudinal sectional view taken along the line A-A of FIG. 13A.

As shown in the plan view of FIG. 11A, the connection portion 120A of the U type core 120 extends with the constant width and connects the leg portions 120B and 120C. However, the induction device 15 may be modified in a manner that the connection portion 120A of the U type core 120 tapers toward the leg portion 120C to present a fan shape, as shown in FIG. 13A and the leg portion 120B broadens its width, accordingly. Also in this case, the area of contact between the leg portion 120B of the U type core 120 and the I type core 130 can be made larger as compared with the cases shown in FIGS. 11A and 12A.

The present invention is not limited to the above embodiments but may be practiced in various ways as exemplified below.

The shape of the leg portions 21B, 21C, 60B, 60C, 80B, 80C, 80D, 100B, 100C, 100D, 120B, 120C, the holes 71, 72, 91, 115, 116, 117, 131 and the recesses 111, 112, 113 of the respective cores may be modified to any shape other than rectangular and circular.

A U-U type core other than the U-I type core, the E-I type core and the E-E type core may be used.

The core is made of a combination of a ferrite core and a dust core in the present invention. The material of the core is not limited to this combination, but the core may be made of a combination of materials having different magnetic permeabilities.

The induction device is applied not only to a reactor but also to a transformer.

What is claimed is:

1. A magnetic core comprising:

a radiator;

a first core; and a second core made of a material whose magnetic permeability is smaller than that of the first core and having an end, wherein the end is in contact with the first core so that the first core and the second core cooperate to form a closed magnetic circuit, wherein the area of contact between the end of the second core and the first core is larger than the area of the cross-section of the end as taken perpendicularly to the extending direction of the end of the second core, wherein the thickness of the first core is larger than that of the second core, and wherein the end of the second core is in contact with the radiator.

2. The magnetic core according to claim 1, wherein the first core includes a hole in which the end of the second core is fitted.

3. The magnetic core according to claim 2, wherein the cross-section of the hole of the first core is square-shaped.

4. The magnetic core according to claim 1, wherein the first core includes a recess in which the end of the second core is fitted.

5. The magnetic core according to claim 1, wherein the first core and the second core are made of a ferrite material and a dust material, respectively.

6. The magnetic core according to claim 1, wherein the surface of contact between the end of the second core and the first core extends forming an arcuate-shape.

7. The magnetic core according to claim 1, wherein the area of the contact is inclined.

8. The magnetic core according to claim 1, wherein the cross-section of the end of the second core is square-shaped.

9. An induction device comprising:

the magnetic core according to claim 1; and a coil wound around the first core or the second core.

* * * * *